US011713638B2

(12) United States Patent
Nordheimer et al.

(10) Patent No.: US 11,713,638 B2
(45) **Date of Patent: *Aug. 1, 2023**

(54) COLLET BAFFLE SYSTEM AND METHOD FOR FRACKING A HYDROCARBON FORMATION

(71) Applicant: SC ASSET CORPORATION, Calgary (CA)

(72) Inventors: David Nordheimer, Calgary (CA); Daniel Rojas, Cypress, TX (US)

(73) Assignee: SC ASSET CORPORATION, Calgary (CA)

( * ) Notice: Subject to any disclaimer, the term of this patent is extended or adjusted under 35 U.S.C. 154(b) by 350 days.

This patent is subject to a terminal disclaimer.

(21) Appl. No.: 16/945,088

(22) Filed: Jul. 31, 2020

(65) Prior Publication Data

US 2020/0362661 A1 Nov. 19, 2020

Related U.S. Application Data

(63) Continuation of application No. 14/991,597, filed on Jan. 8, 2016, now Pat. No. 11,506,013.

(51) Int. Cl.
*E21B 33/12* (2006.01)
*E21B 43/26* (2006.01)
(Continued)

(52) U.S. Cl.
CPC ..... *E21B 33/12* (2013.01); *E21B 34/14* (2013.01); *E21B 43/26* (2013.01); *E21B 31/00* (2013.01)

(58) Field of Classification Search
CPC ..... E21B 33/12; E21B 34/14; E21B 43/26; E21B 31/00
See application file for complete search history.

(56) References Cited

U.S. PATENT DOCUMENTS 47,804 A * 5/1865 Daniels ..... E21B 31/20 294/86.24
776,523 A * 12/1904 Lukins ..... E21B 31/20 294/86.25

(Continued)

FOREIGN PATENT DOCUMENTS

AU 2016413286 B2 10/2021
CA 2879044 A1 3/2015

(Continued)

OTHER PUBLICATIONS

International Search Report issued in PCT/CA2016/050455, dated Sep. 20, 2016, pp. 1-3.

(Continued)

*Primary Examiner* — Robert E Fuller
*Assistant Examiner* — Neel Girish Patel
(74) *Attorney, Agent, or Firm* — Gowling WLG (Canada) LLP

(57) ABSTRACT

A retrieving tool for retrieving an annular hollow baffle member in a wellbore. The baffle member has an interior bore and radially outwardly-biased collet finger protuberances on an exterior thereof matingly engaging a correspondingly-dimensioned annular recess within a landing sub of a well casing of the wellbore. The retrieving tool has a tubular body and a plurality of radially-outwardly-extendable dogs thereon. The tubular body and the dogs are sized that, when the dogs are retracted, the retrieving tool is movable through the interior bore of the baffle member to a position below a lowermost thereof, and when the dogs are extended after the retrieving tool moves to said position, the dogs radially engageable with the landing sub and axially engageable with the lowermost of baffle member for pulling the baffle member uphole and disengaging it from the landing sub for retrieving the entirety of the baffle member.

12 Claims, 16 Drawing Sheets

(51) Int. Cl.
*E21B 34/14* (2006.01)
*E21B 31/00* (2006.01)

(56) References Cited

U.S. PATENT DOCUMENTS 1,433,722 A * 10/1922 Hinderliter ..... E21B 29/00 166/55.2
1,445,581 A * 2/1923 Fullop ..... E21B 31/20 294/86.2
2,897,896 A * 8/1959 Kenneday ..... E21B 23/02 166/134
2,904,114 A * 9/1959 Webb ..... E21B 31/16 294/86.18
2,980,185 A * 4/1961 Daffin ..... E21B 23/02 166/123
4,254,983 A * 3/1981 Harris ..... E21B 31/16 294/86.21
4,626,134 A * 12/1986 Coumont ..... E21B 31/20 405/184
5,086,844 A * 2/1992 Mims ..... E21B 43/10 166/212
5,398,760 A * 3/1995 George ..... E21B 23/01 166/385
5,398,763 A * 3/1995 Watson ..... E21B 23/02 166/242.6
5,398,764 A * 3/1995 Collins ..... E21B 23/02 166/212
5,538,082 A 7/1996 Zwart
6,439,313 B1 * 8/2002 Thomeer ..... E21B 43/108 166/376
7,325,617 B2 2/2008 Murray
7,395,856 B2 7/2008 Murray
7,552,779 B2 6/2009 Murray
8,499,840 B2 * 8/2013 Bennett ..... E21B 43/105 166/242.6
8,499,844 B2 * 8/2013 Gandikota ..... E21B 33/128 166/387
8,839,873 B2 * 9/2014 Johnson ..... E21B 33/1208 166/55
9,611,727 B2 4/2017 Campbell et al.
9,739,117 B2 8/2017 Campbell et al.
11,506,013 B2 * 11/2022 Nordheimer ..... E21B 33/12
2003/0173089 A1 * 9/2003 Westgard ..... E21B 23/02 166/381
2005/0011650 A1 * 1/2005 Harrall ..... E21B 43/106 166/207
2007/0221384 A1 * 9/2007 Murray ..... E21B 34/063 166/185
2009/0065196 A1 * 3/2009 Holland ..... E21B 43/103 166/380
2011/0277989 A1 * 11/2011 Frazier ..... E21B 34/14 166/192
2012/0074722 A1 * 3/2012 Beach ..... E21B 31/20 294/86.1
2012/0085539 A1 * 4/2012 Tonnessen ..... E21B 43/119 166/55
2012/0168180 A1 * 7/2012 Johnson ..... E21B 33/1208 166/386
2013/0037255 A1 * 2/2013 Kash ..... E21B 43/116 166/55
2013/0081827 A1 * 4/2013 Etzel ..... E21B 43/14 166/318
2013/0186647 A1 * 7/2013 Xu ..... E21B 33/129 166/207
2014/0246207 A1 9/2014 Hofman et al.
2014/0251612 A1 * 9/2014 Powers ..... E21B 23/00 166/179
2014/0345878 A1 * 11/2014 Murphree ..... C09K 8/94 166/377
2016/0251923 A1 9/2016 Keerthivasan et al.
2017/0130535 A1 * 5/2017 Helvenston ..... E21B 33/072

FOREIGN PATENT DOCUMENTS

CA 2904470 A1 11/2015
CN 1714226 A 12/2005
CN 102918227 A 2/2013
CN 103097653 A 5/2013
CN 204532245 U 8/2015
RU 2314415 C2 1/2008
RU 2415254 C1 3/2011
RU 2435938 C2 12/2011
RU 2651865 C2 4/2018
RU 2683294 C1 3/2019
WO 2004070162 A1 8/2004
WO 2014046841 A2 3/2014

OTHER PUBLICATIONS

Written Opinion issued in PCT/CA2016/050455, dated Sep. 20, 2016, pp. 1-3.
Site Oil Tools Ltd. 1981-1982 Wireline Production Equipment Catalogue.

* cited by examiner

COLLET BAFFLE SYSTEM AND METHOD FOR FRACKING A HYDROCARBON FORMATION

FIELD OF THE INVENTION

The present invention relates to a baffle system and method for fracturing or treating a hydrocarbon formation. More particularly, the present invention relates to a baffle system where one or all of the baffles employed during fracking are retrievable from a well casing.

BACKGROUND OF THE INVENTION

This background and patent documents identified below are provided for the purpose of making known information believed by the applicant to be of possible relevance to the present invention, and in particular allowing the reader to understand advantages of the invention over devices and methods known to the inventor, but not necessarily public. No admission is necessarily intended, nor should be construed as admitting, that any of the following documents or methods known to the inventor constitute legally citable and relevant prior art against the present invention.

Preferably when fracking a wellbore it is usually necessary, for optimization of pressurized and to concentrate volumes of fluid in localized areas, particular zones along the wellbore are opened to the formation to allow fracking of the formation in such area while isolating (i.e. closing off) all other zones along the well casing during such localized fluid injection. Such typically results in having to isolate, by means of packers or plug members pumped downhole, certain segments of the wellbore which may be otherwise open to the formation. Alternatively, where the well casing possesses slidable sleeves which are typically closed during insertion of and cementing of the casing in the wellbore, only select slidable sleeves along the well liner are opened, to thus allow introduction of high pressure fluid only into a targeted zone of the formation along the wellbore while still maintaining all sleeves in unfracked areas along the well casing closed.

Each of the foregoing scenarios results in actuation means such as sleeves, balls, packers, or the like being provided down the well to achieve in some manner the desired isolation to achieve fracking of a specific region of the formation.

Often such equipment or tools, while often annular and having a flow-though passage, are permanently left in the well, thereby substantially restricting to some degree the flow of produced hydrocarbons through the well casing due to resulting reduced diameter of the wellbore.

Alternatively, difficult and expensive reaming operations need to be conducted to ream out any remaining plug members or actuation sleeves used in the fracking process to thereby maintain full production diameter of the wellbore when the wellbore goes to production.

Certain published documents teach, with varying degrees of success and complexity, various equipment and methods for isolating segments of the wellbore for fracking purposes while attempting to maintain, after fracking, as unrestricted a flow passage from the well casing as possible.

For example, CA 2,879,044 entitled "System and Method for Injecting Fluid at Selected Locations Along a Wellbore" teaches a system and method for selectively actuating (moving from closed position to open position) a plurality of sliding sleeves in a tubing liner, which are covering ports in the tubing liner, via one or more darts inserted into the wellbore to allow fracking of the wellbore in the regions of the opened ports. The actuating dart is preferably coupled to a retrieval tool (or is coupleable to a retrieving tool) which upon the retrieval tool being so coupled allows a bypass valve to be opened to thereby assist in withdrawing the dart from within the valve sub-members. Upward movement of the retrieval tool allows a wedge-shaped member to disengage the dart member from a corresponding actuated sleeve to allow the dart and retrieving tool to be withdrawn from the wellbore. The sliding sleeve nevertheless remains in the well liner.

As is apparent from the above, the invention of CA 2,879,044 is directed to tubing liners/well casing having pre-existing sliding sleeve members therein covering ports in the tubing liner. As such, this invention is directed to, and only utilizable with, tubing liners of such (pre-existing) configuration, and accordingly is not directed to nor utilizable in well casings which do not possess pre-existing sliding sleeves covering pre-existing ports in such tubing liners.

CA 2,904,470 entitled "System for Successively Uncovering Ports along a Wellbore to Permit Injection of a Fluid along said Wellbore" having a common inventor with the present invention, teaches a system for moving sleeves to successively uncover a plurality of contiguous ports in a tubing liner within a wellbore which are covered by such sleeves, or for successively uncovering individual groups of ports arranged at different locations along the liner, to allow successive fracking of the wellbore at such locations. Sliding sleeves in the tubing liner are successively moved from a closed position covering a respective port to an open position uncovering such port by an actuation member placed in the bore of the tubing liner and pumped down the tubing liner. The actuation member for moving the sliding sleeves to cause them to open comprises a single collet sleeve, having a dissolvable plug retained in a fixed position within such collet sleeve by shear pins. The collet sleeve has radially-outwardly biased protuberances (fingers) at a downhole end thereof, adapted to and which matingly engage corresponding cylindrical grooves in such sliding sleeves, based on the width of the protuberance. Upon the actuation member actuating all of the desired sleeves and after having actuated the last most downhole sleeve, the shear pin shears thereby allowing the plug in the collet to move downhole in the collet sleeve and thereby preventing the protuberances (fingers) on the collet sleeve from thereafter disengaging the cylindrical groove of the corresponding sliding sleeve, thereby preventing any further progress of the collet sleeve downhole.

Again as will be apparent, such invention like the invention disclosed in CA 2,879,044 is directed to tubing liners/well casing having pre-existing sliding sleeve members therein covering ports in the tubing liner. As such, this invention is directed to, and only utilizable with, tubing liners of such (pre-existing) configuration, and accordingly is not directed to nor utilizable in well casing which does not possess pre-existing sliding sleeves covering pre-existing ports in such tubing liner.

U.S. Pat. No. 5,398,763 entitled "Wireline Set Baffle and Method of Setting Thereof", in contrast to the above two patent publications, teaches a setting tool which may be used to position a baffle within a well casing, which baffle may then act as a seat for a plug member which is then inserted downhole to isolate downhole sections, and thereby allow such regions of the casing above the baffle which are perforated to be fracked. To such extent U.S. Pat. No. 5,398,763 have a number of similarities with the present invention.

However, the apparatus and method of U.S. Pat. No. 5,398,763 has a number of important differences with the system and method of the present invention, not the least of which, in respect of the second, third, and fourth embodiments thereof, is the need for explosive charges to shear shear pins or the need of actuating blasting cap on the setting tool, which adds to the complexity and expense of a setting tool.

Despite the above prior art teachings, a need still exists in the fracking industry for a simple system and method for effectively isolating certain sectors of a wellbore for fracking, which after completion of the fracking along a length of a wellbore nonetheless leaves the length of the wellbore virtually unrestricted and of maximum original diameter to maximize flow of hydrocarbons therethough during production.

It is further advantageous if such a system and method can further at the same time provide accurate perforation of the well casing, to minimize errors in depth placement of the perforations along the wellbore and to minimize the number of tripping in and out of the wellbore of various equipment if perforation and fracking operations were otherwise independently conducted, to speeding up perforating and fracking operations in completing wells for production.

SUMMARY OF THE INVENTION

It is thus an object of the present invention to provide a relatively simple system and method for fracking which allows the desired isolation of particular successive segments along a wellbore, yet nonetheless after completion of fracking leaves the wellbore virtually unrestricted and of maximum original diameter to increase flow during production.

It is a further object of certain embodiments of the present invention to provide a baffle member which may be uniquely engaged with a landing sub at a known depth along the wellbore, which temporarily effectively prevents flow of pressurized fracking fluids downhole but which baffle member may after completion of perforation and fracking operations be easily removed from the well casing leaving the well casing unrestricted.

It is a further object of certain embodiments of the present invention to provide a method for fracking a formation, which after such operation leaves the wellbore virtually unrestricted and of maximum original diameter to increase flow during production.

Accordingly, in order to overcome some of the disadvantages of the prior art designs and/or in order to further realize one or more of the above non-limiting objects of the present invention, the collet baffle system and method of the present invention generally comprises a number of components, having:

(i) landing subs within the well casing, each having an annular recess of a unique configuration (each typically being of a unique width and/or if a plurality of annular recesses per landing sub, each of a unique width and/or spacing);

(ii) one or more baffle members, wherein such baffle members each possess collet finger protuberances thereon configured to matingly engage a unique landing sub in the well casing, wherein the protuberances are further provided with a shoulder on a downhole side thereof to prevent further passage of the baffle member downhole, and with a chamfer on an uphole side thereof to allow for disengagement of the collet finger protuberances with the landing sub and thus removal of the baffle member after it has served its purpose (as further explained herein);

(iii) a plug member which may be inserted or flowed down the well casing, which becomes seated in the baffle member and prevents pressurized fracking fluid from flowing past the baffle member and thereby causes such fluid to flow into the formation via perforations in the casing located immediately above the particular landing sub; and (iv) a conveying tool, which is frangibly connected to the baffle member such as by shear pins, which may be withdrawn from the well casing after mating engagement of the baffle member with the desired landing sub in the well casing.

The landing subs are deployed in the casing install on desired depth and spacing. Each landing sub, in one embodiment of the invention, has its own unique landing length for the matching collet finger protuberances on a particular baffle member. For example, the landing sub at the toe of the wellbore will have the longest profile, with each consecutive profile/annular recess in each landing sub being of a reduced length progressing from heel to toe (in a deviated well) or from the base of the well upwards in a vertical well.

Landing subs can be run in to the wellbore with a desired spacing, which may be every 30 meters, for example, or some other unique configuration tailored to the geology of the formation. After the casing has been installed and cemented into place the wireline (or coiled tubing) and frac equipment will rig up. The baffle member is frangibly affixed to a standard conveying tool, such as Baker Style #20 setting tool, such as by a shear pin of a selected/desired shearing force. The conveying tool may further be provided with perforating guns, to allow precise location of the perforations in the well casing relative to each landing sub.

The assembly (baffle member, conveying tool, and perforating guns) may then be conveyed downhole via wireline or coiled tubing. Once the baffle member forming part of the aforementioned assembly has reached its target landing sub and the annular recess therein, the collet finger protuberances on the baffle member expand radially outwardly to matingly engage the target landing sub, thereby preventing the baffle member from any further downhole movement. Circumferential external seals on the baffle member provide a seal against the landing sub. The conveying tool is now forceably pulled uphole, causing the shear pins to shear allowing the conveying tool to disengage from the baffle member and leaving the baffle member engaged with the target landing sub. The conveying tool and perforating guns are now moved (if desired) to a desired perforating depth above the landing sub, and the perforating guns activated. The perforating guns and conveying tool are then pulled to surface. A plug member, such as a dissolvable ball, it then pumped or flowed downhole with fracturing fluid. The ball lands on a ball seat on the baffle member, and creates a seal. The fracture fluid is then pumped into the formation via the perforations created in the well casing at the desired depth.

The aforementioned process may be repeated, albeit with a second baffle member having collet finger protuberances of a different (lesser) width or spacing than those employed on the first baffle member, to allow earlier engagement of a landing sub immediately uphole from the lowermost landing sub.

The first baffle member, prior to landing of additional baffle members in corresponding landing subs, may be removed by means of a retrieving tool. Typically, however, the baffle members are left in the wellbore until after perforation and fracking. After completion of perforating and fracking of the formation, the balls seated therein dissolve. Prior to initiation of production the baffle members can all be simultaneously retrieved by running a retrieving tool to the toe of the well, activating dogs on the retrieving tool, and pulling the retrieving tool uphole—the chamfer on the uphole side of the recesses in the landing subs and/or a chamfer on the uphole side of the collet finger protuberances allows release of each of the baffle members from mating engagement with their respective landing subs. The recovery of the baffle members to surface advantageously allows for dramatically increased inner diameter of the well casing for increased flow back and production.

More particularly, in a first broad embodiment of the present invention, the invention comprises a baffle system for use in a well casing having a plurality of landed subs longitudinally spaced therealong, for progressively fracking or treating fluid into a hydrocarbon formation via existing or created perforations in said well casing, said system comprising:

an annular baffle member, insertable within said well casing, having at a most-uphole end thereof a seating surface configured to provide to a plug member dropped downhole in said well casing a seating surface against which said plug member may abut to thereby prevent pressurized fluid injected downhole in said well casing from travelling past said plug member, said baffle member further having radially outwardly-biased collet finger protuberances thereon configured to matingly engage a correspondingly-dimensioned annular recess within one of said plurality of landing subs within said well casing;

a conveying tool, affixed at a lowermost end thereof via frangible means to an upper interior portion of said annular baffle member;

the annular recess on a downhole side edge thereof possessing a shoulder portion which prevents further downhole movement of said baffle member within said well casing upon said collet finger protuberances engaging said annular recess; and the annular recess and/or said collet finger protuberances at an uphole side edge thereof possessing a chamfer such that upward force applied to said baffle member causes radial compression of said collet finger protuberances and disengagement of said collet finger protuberances with said annular recess and thus release of said baffle member from mating engagement with said annular recess thereby allowing said baffle member to be withdrawn uphole in said well casing via a retrieving tool.

In a preferred embodiment, the frangible means comprise shear pins or shear screws which affix the conveying tool, at a lower region thereof, to an upper portion of the baffle member. The conveying tool is preferably frangibly affixed to the baffle member uphole of the collet finger protuberances thereon.

In a further preferred embodiment, the baffle member, at an uppermost portion about an interior peripheral mouth thereof, has a chamfer to allow radially-outwardly biased dogs on a retrieving tool inserted therein to be radially compressed and thereby allow said retrieving tool to pass therethrough; and at a lowermost portion has a shoulder to allow said radially-outwardly biased dogs after having passed through said baffle member to abut said dogs and allow said retrieving tool, when pulled uphole, to thus pull said baffle member uphole.

The baffle system in preferred embodiments is provided with a plurality of annular recesses respectively situated within a corresponding plurality of said landing subs, longitudinally spaced apart from each other along said well casing, a most downhole of said plurality of annular recesses having the greatest annular width, with remaining uphole annular recesses having, when progressing uphole along said well casing, progressively narrower widths.

The conveying tool, and in particular a conveying head thereof, is preferably provided with an electrically-actuated explosive charge for perforating said well casing.

Preferentially, each landing sub has a respective annular recess therein, wherein a respective annular baffle member when matingly engaged within a landing subs thereby positions said explosive charge immediately above said respective landing subs, so that said explosive charge, when detonated, perforates the well casing immediately above the desired landing sub.

In one embodiment the radially outwardly-biased collet finger protuberances are situated approximately midpoint on said baffle member, intermediate annular seals situated on an outer periphery of said baffle member at mutually opposite ends thereof. The collet finger protuberances may alternatively, if desired, simply be situated at a distal (downhole) end of the baffle member, and not midpoint thereof.

Preferentially, the conveying tool has a bypass port therein to allow fluid to flow therethrough when lowering said conveying tool within said well casing.

In another broad aspect of the present invention, the present invention comprises a method for fracking or treating a hydrocarbon formation having a well casing located therein and having a plurality of landing subs spaced along said well casing, commencing with the most distal regions of said well casing and progressing uphole along said well casing until all regions of said hydrocarbon formation have been fracked or treated, comprising the steps of:

(i) inserting well casing having a plurality of landing subs spaced therealong in a well drilled within said hydrocarbon formation, each of said landing subs having an annular recess therein, said annular recesses being of a progressively greater width progressing downhole along said well casing;

(ii) affixing to a most downhole end of a conveying tool, via frangible means, a first baffle member having outwardly-biased collet finger protuberances thereon of a width adapted to matingly engage a lowermost of said annular recesses;

(iii) inserting said conveying tool and baffle member downhole in said well casing until said collet finger protuberances engage said lowermost of said annular recesses;

(iv) pulling uphole on said conveying tool and causing said frangible means thereon to shear thereby releasing said baffle member from said conveying tool;

(v) withdrawing said conveying tool from said well casing;

(vi) lowering or flowing a plug member into said well casing and causing said plug member to abut an uppermost portion of said baffle member so as to prevent passage of pressurized fluid downhole of said baffle member;

(vii) injecting a pressurized fluid into said well casing and flowing said pressurized fluid into said formation via perforations in said well casing proximate and above said lowermost landing sub and plug member situated therein;

(viii) causing said plug member to be removed from said well casing;

(ix) repeating steps (ii) to (viii), save in each iteration said baffle member has collet finger protuberances of a lesser width and in each iteration, which respectively engage progressively more uphole annular recesses in each of said plurality of landing subs which such more uphole annular recesses each likewise of correspondingly lesser width, until said hydrocarbon formation has been fracked or treated.

In an alternative embodiment, such method comprises the steps of:

(i) inserting well casing having a plurality of landing subs spaced therealong in a well drilled within said hydrocarbon formation, each of said landing subs having a plurality of annular recesses therein, said annular recesses longitudinally spaced apart within said landing sub and being of a unique spacing unique to each landing sub;

(ii) affixing to a most downhole end of a conveying tool, via frangible means, a first baffle member having outwardly-biased collet finger protuberances thereon of a spacing adapted to matingly engage said annular recesses in a lowermost of said landing subs;

(iii) Inserting said conveying tool and baffle member downhole in said well casing until said collet finger protuberances engage said annular recesses in a lowermost of said landing subs;

(iv) pulling uphole on said conveying tool and causing said frangible means thereon to shear thereby releasing said baffle member from said conveying tool;

(v) withdrawing said conveying tool from said well casing;

(vi) lowering or flowing a plug member into said well casing and causing said plug member to abut an uppermost portion of said baffle member so as to prevent passage of pressurized fluid downhole of said baffle member;

(vii) injecting a pressurized fluid into said well casing and flowing said pressurized fluid into said formation via perforations in said well casing proximate and above said lowermost landing sub and plug member situated therein;

(viii) causing said plug member to be removed from said well casing;

(ix) repeating steps (ii) to (viii), save in each iteration said baffle member has collet finger protuberances of unique spacing, which respectively engage progressively more uphole annular recesses in each of said plurality of landing subs, until said hydrocarbon formation has been fracked or treated.

In a preferred embodiment of the above two methods, the annular recesses, on an uphole side edge thereof and/or said collet finger protuberances, on an uphole side thereof, have a chamfered portion to allow withdrawal of finger protuberances therewith.

In one refinement of the above methods, after step (viii) the following steps may be inserted, namely:

lowering a retrieving tool having radially extending dogs downhole in said well casing, such that said dogs are lowered past said baffle member;

actuating said dogs on said retrieving tool radially outwardly; and pulling uphole on said retrieving tool and withdrawing said retrieving tool and said baffle member from within said well casing.

In another alternatively refinement of the above methods, after step (ix) the following steps may be added, namely:

lowering a retrieving tool having radially extending dogs downhole in said well casing, such that said dogs are lowered past a lowermost of said baffle members;

actuating said dogs on said retrieving tool radially outwardly; and pulling uphole on said retrieving tool and simultaneously withdrawing said retrieving tool and all of said baffle members uphole thereof from within said well casing.

In a further refinement of the above method, such method further comprises the step, after step (iii) and after said annular baffle member has matingly engaged within a lowermost of said landing subs, of:

igniting an explosive charge on said conveying tool immediately above said lowermost of said plurality of landing subs, and detonating said explosive charge so as to perforate the well casing immediately above said lowermost landing sub.

The above summary of the invention does not necessarily describe all features of the invention. For a complete description of the invention, reference is to further be had to the drawings and the detailed description of some preferred embodiments, read together with the claims.

BRIEF DESCRIPTION OF THE DRAWINGS

Further advantages and other embodiments of the invention will now appear from the above along with the following detailed description of the various particular embodiments of the invention, taken together with the accompanying drawings each of which are intended to be non-limiting, in which:

FIGS. 7-14 show successive views of the operation of the system and method of the present invention, wherein:

FIG. 7 depicts the conveying tool directing a first baffle member downwardly in the well casing, the lowest two landing subs in said well casing being shown (not to scale);

FIG. 8 is a subsequent view in the method of operation of the present invention, wherein the conveying tool has conveyed the baffle member to the lowest landing sub, and the collet finger protuberances on the baffle member have engaged the annular recess of corresponding dimensions in the landing sub;

FIG. 9 is a subsequent view in the method of operation of the present invention, wherein an upward force has been applied to the conveying tool and as a result the shear pins affixing the baffle member to the conveying tool have become sheared, and the conveying tool is being removed uphole;

FIG. 10 is a subsequent view in the method of operation of the present invention, wherein the conveying tool has been removed from the well casing;

FIG. 11 is a subsequent view in the method of operation of the present invention, wherein a dissolvable ball has been flowed downhole, and has become seated in the ball seat in the baffle member, thereby now preventing flow of pressurized fluid downhole, and wherein such pressurized fluid may now be caused to flow through perforations in the well casing uphole of the ball and particular landing sub;

FIG. 12 is a subsequent view in the method of operation of the present invention, wherein the injection of fluid into the formation via perforations in the casing has been completed, the ball has dissolved, and a baffle retrieving tool is being inserted downhole in the casing to retrieve the baffle member;

FIG. 13 is a subsequent view in the method of operation of the present invention, wherein the retrieving tool has been positioned to allow the dogs thereof to become extended; and FIG. 14 is a subsequent view in the method of operation of the present invention, wherein the retrieving tool and baffle member are being withdrawn uphole;

DETAILED DESCRIPTION OF SOME PREFERRED EMBODIMENTS OF THE INVENTION

Figure 1:
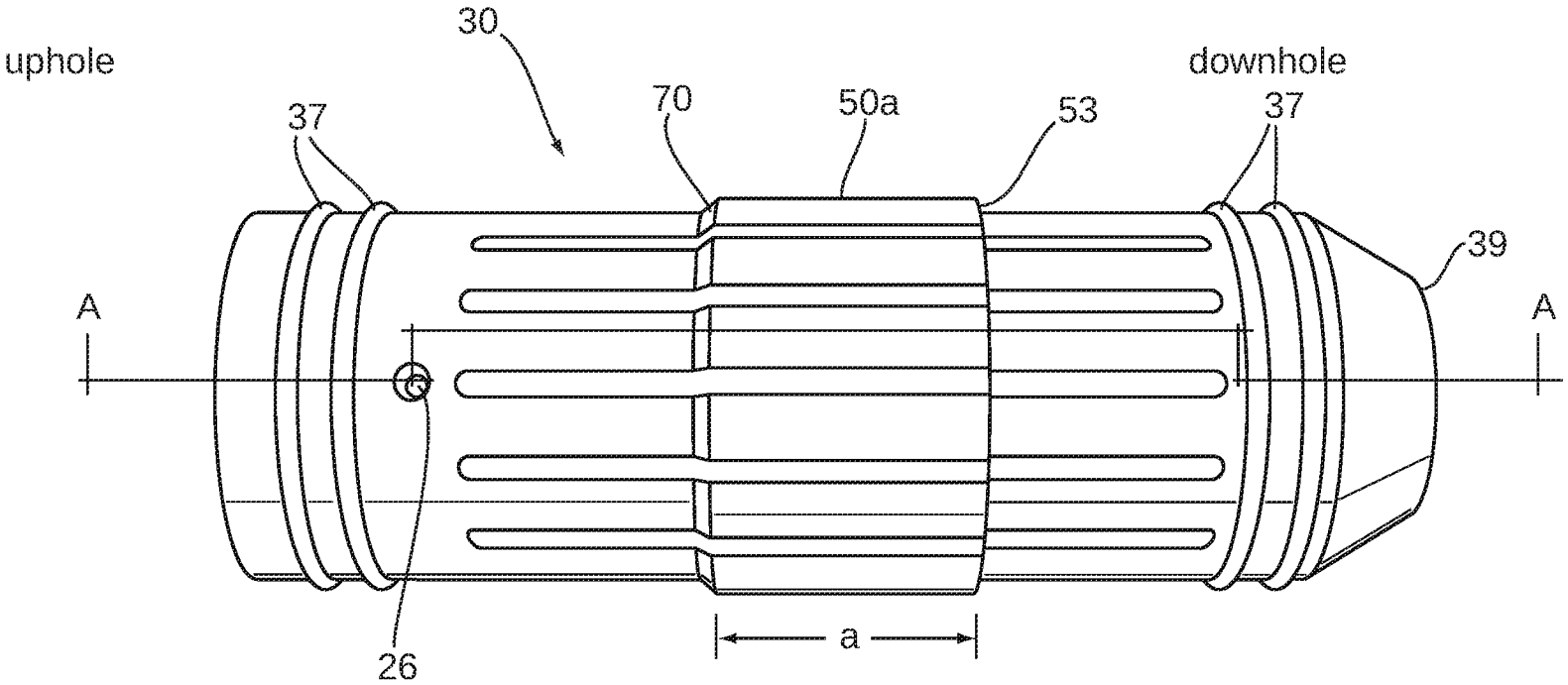
FIG. 1 is a side perspective view of a baffle member which forms part of the system of the present invention.

In the following description, similar components in the various drawings are identified with corresponding same reference numerals.

Reference to an element in the singular, such as by use of the article "a" or "an" is not intended to mean "one and only one" unless specifically so stated, but rather "one or more".

Reference to the relative terms "upper", "uppermost", "above", "below", "lowermost", or "bottom" are with reference to the position of a component within a vertical well casing.

"Downhole" consistently means toward the end of the well or well casing, regardless as to whether such well or well casing is vertical, or is horizontal or deviated as occurs in deviated wells.

In the drawings, the following convention is adopted, namely downhole within a wellbore or well casing is toward the bottom of the page for portrait-style figures, and to the right of the page for landscape-style figures.

FIGS. 7-14 show one embodiment 10 of the baffle system and the method of the present invention, for use in a well casing 12 having a plurality of landing subs 14*a*, 14*b* longitudinally spaced along the well casing 12.

Specifically, FIGS. 7-14 show one embodiment 10 of the baffle system of the present invention, in successive steps of operation and implementation.

Pre-existing perforations (not shown) may be provided in well casing 12, but preferentially are created in well casing 12 in the manner described herein, immediately prior to fracking a zone of the formation along the well casing.

As may be seen, landing subs 14*a*, 14*b* threadably coupled at together 18 via standard threaded couplings to form an integral well casing 12, are provided at spaced locations along well casing 12, each landing sub 14*a*, 14*b* have at least one annular recess 16 therein. The annular recess 16' in the lowermost of landing subs 14*a* is of the greatest length (width) "a", and successively more uphole landing subs, such as landing sub 14*b*, have a corresponding annular recesses 16" therein of a progressively lesser width "b", as shown in FIG. 7.

Importantly, each annular recess 16, on a downhole side edge thereof, is provided with a shoulder 17, which prevents further downhole movement of a baffle member 30 once said baffle member has become matingly engaged, in the manner set out below, with a respective annular recess 16. In a preferred embodiment shoulder 17 on each is "back-milled", and similarly matingly engages shoulder 53 on baffle member 30 which is similarly "back milled, as best shown in FIGS. 4, 6, and 9-11, to thereby assist in ensuring shoulder 17 prevents baffle member 30 once protuberances 50 thereof are matingly engaged in a respective annular recess 16, from further passing downhole in well casing 12.

Figure 6:
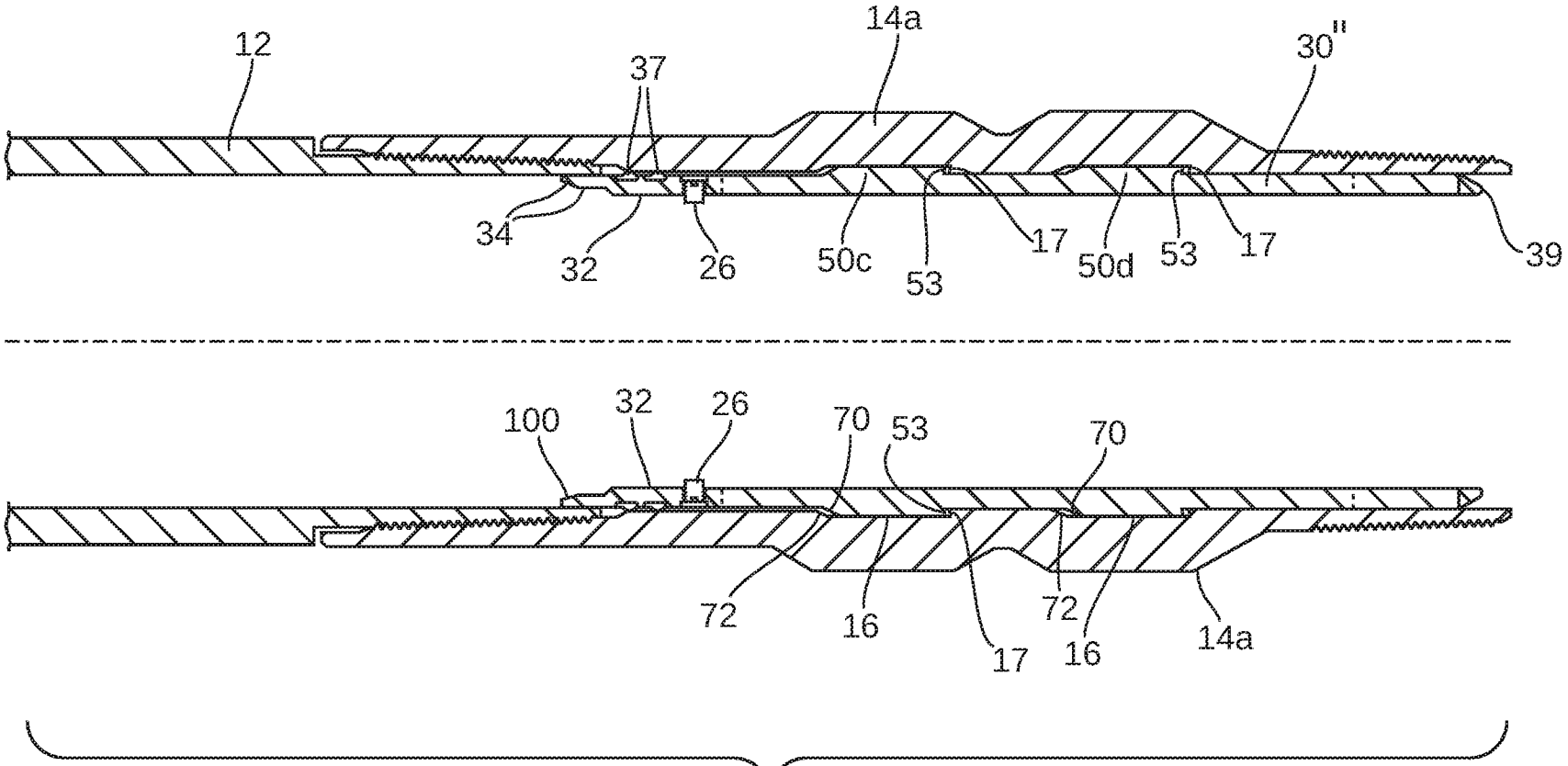
FIG. 6 is a cross-section of the baffle member of FIG. 5 when matingly engaging a landing sub in accordance with another embodiment of the present invention.
Figure 7:
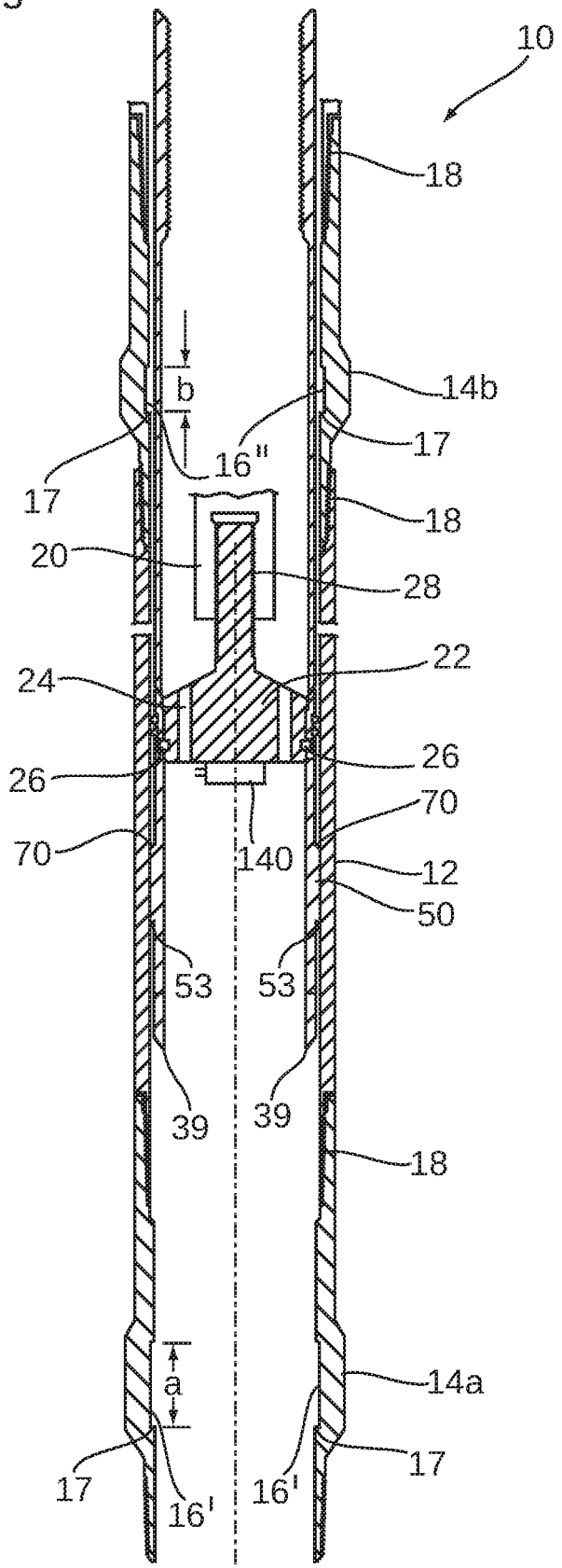

In order to commence a fracking operation, as seen from FIG. 7, a conveying tool 20 (which may comprise a Baker Style #20 setting tool) to which a conveying head 22 is associated, firstly conveys downhole in well casing 12 a baffle member 30. Conveying head 22 has coupled thereto the aforesaid baffle member 30, embodiments of such baffle member 30 being most clearly depicted in FIGS. 1-6.

In the embodiment shown in FIG. 7, conveying head 22 is threadably coupled via threads 28 to conveying tool 20. In the embodiment shown in FIG. 8, conveying tool 22 is merely coupled to or forced downhole by a tubular conveying tool 20.

Figure 8:
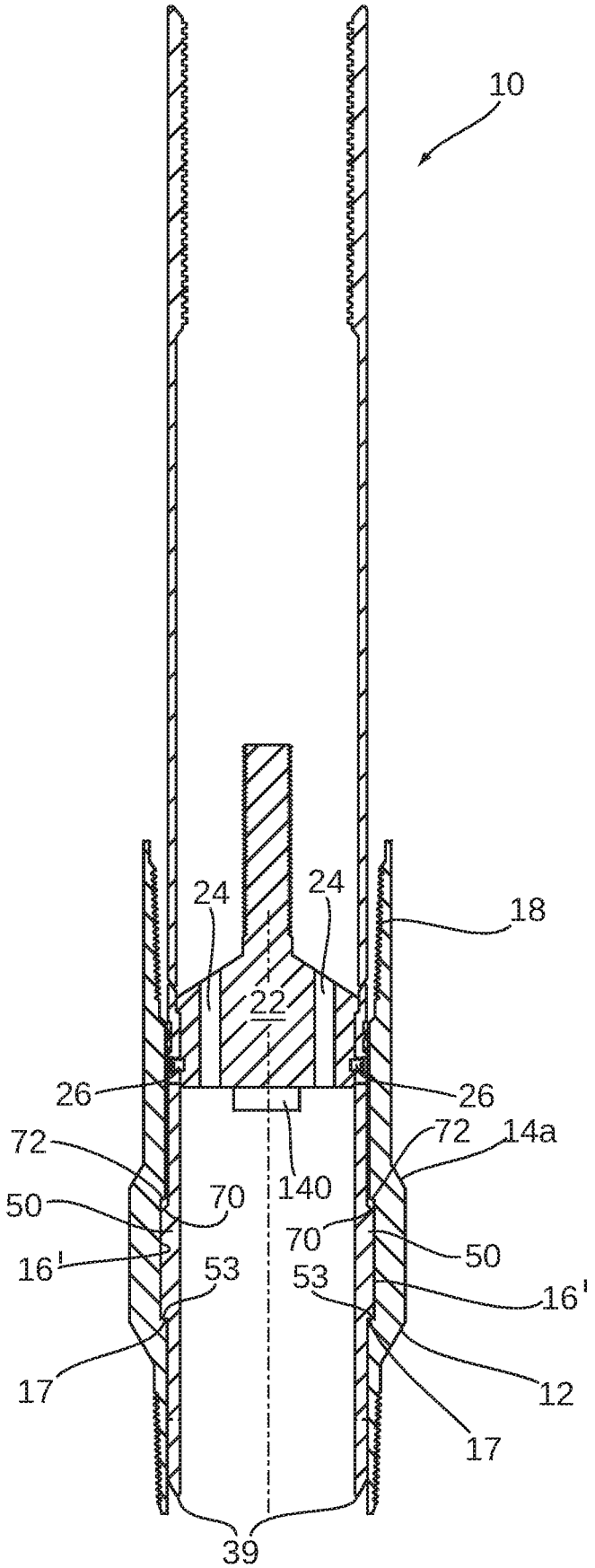

As seen from FIGS. 7-8, conveying head 22 has bypass ports 24 therein to allow passage of fluid therethrough when conveying head 22 is lowered in said well casing 12. Conveying tool 20, comprising in one embodiment conveying head 22, may be conveyed downhole in well casing 12 via wireline or via coiled tubing (not shown).

As noted above, conveying head 22 is frangibly secured at a lower end thereof to an upper interior portion 32 of baffle member 30. Such securement (coupling) of baffle member 30 to conveying head 22 of conveying tool 20 is a frangible connection, via shear screws 26. Other means of frangibly securing baffle member 30 to conveying head 22 will now occur to persons of skill of the art, such as using tack welding forming a breakable/shearable weld joint, or by friction-fit shear pins (not shown) which are shearable, and each of said alternative frangible means are expressly contemplated within the scope of the invention.

Figure 11:
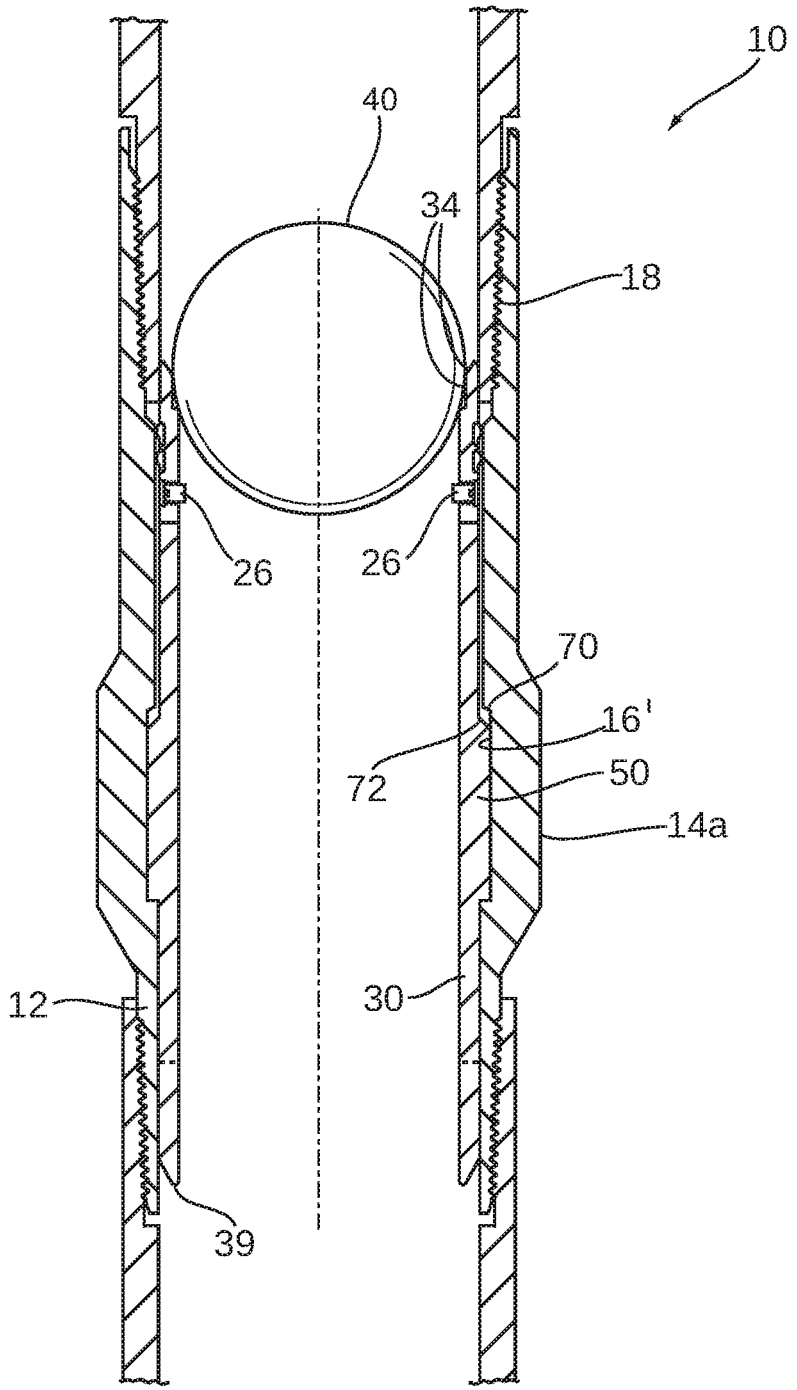

Baffle member 30, as best seen from the various embodiments thereof in FIGS. 1-6, is insertable within well casing 12. A most uphole end of baffle member 30 has an interior seating surface 34 configured to provide a plug member 40 (ref. FIG. 11) such as a dissolvable ball or dart when dropped downhole in well casing 12 with a seating surface 34 against which plug member 40 may abut, to thereby prevent pressurized fluid injected downhole in well casing 12 from travelling past plug member 40 when pressurized fluid is to be injected in the well casing 12 to frac the formation above a baffle 30 and respective landing sub 14*a*. One or more circumferential seals 37 may be located above and/or below protuberances 50 on baffle member 30, to assist in preventing, when a plug member 40 is seated in baffle member 30, any pressurized fluid from travelling downhole from the respective landing sub 14 in which the respective baffle member 30 is matingly engaged.

Baffle member 30 is provided with a plurality of radially outwardly-biased collet finger protuberances 50, which are preferentially located at a midpoint of baffle member 30 (see FIGS. 1-6), but may be located at a distal (i.e. downhole) end thereof (not shown). Protuberances 50*a* of width "a" are situated about the periphery of baffle member 30 (FIG. 1), protuberances 50*b* of width "b" are situated about the periphery of baffle member 30' (FIG. 3), and protuberances 50*c* and 50*d* of respective widths "c" and "d" are situated about the periphery of baffle member 30" (FIG. 5).

Figure 2:
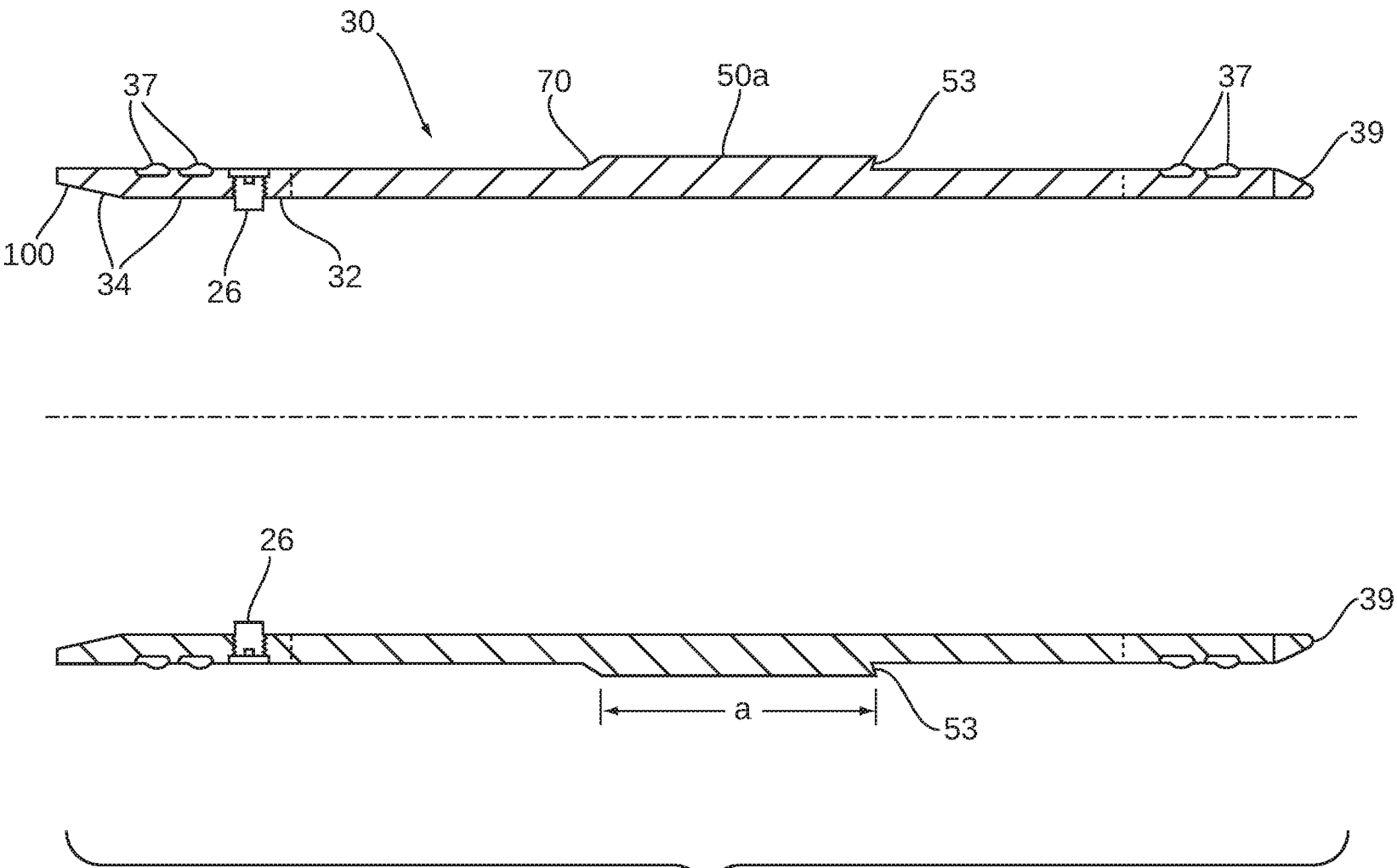
FIG. 2 is a cross-section of the baffle member of FIG. 1, taken along plane A-A.

Specifically, baffle member 30 shown in FIGS. 1-2 is used for engaging a lowermost 14*a* of landing subs 14 and has a single set of radially outwardly-biased collet finger protuberances 50*a* about periphery of baffle member 30, each of length (width) "a". Protuberances 50*a* are adapted to matingly engage annular recess 16' of equal or greater corresponding width of lowermost landing sub 14*a*.

Figure 3:
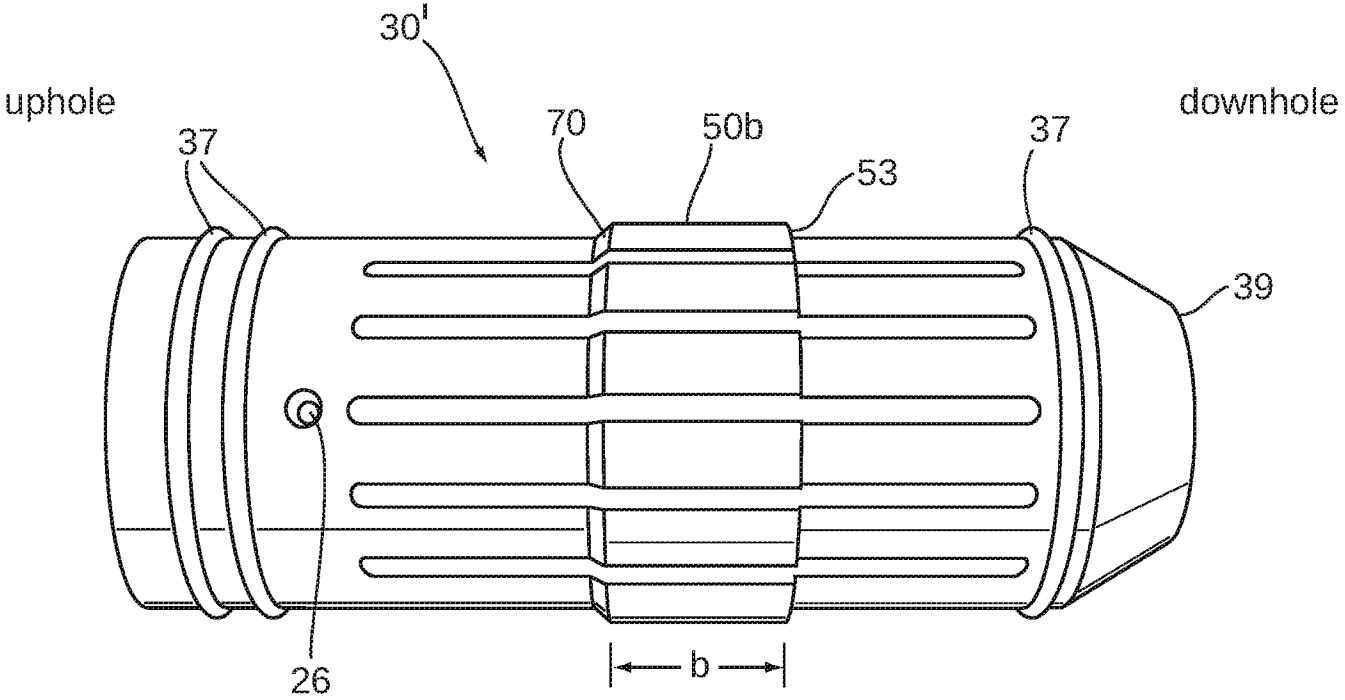
FIG. 3 is a is a side perspective view of another baffle member for use in the system of the present invention.
Figure 4:
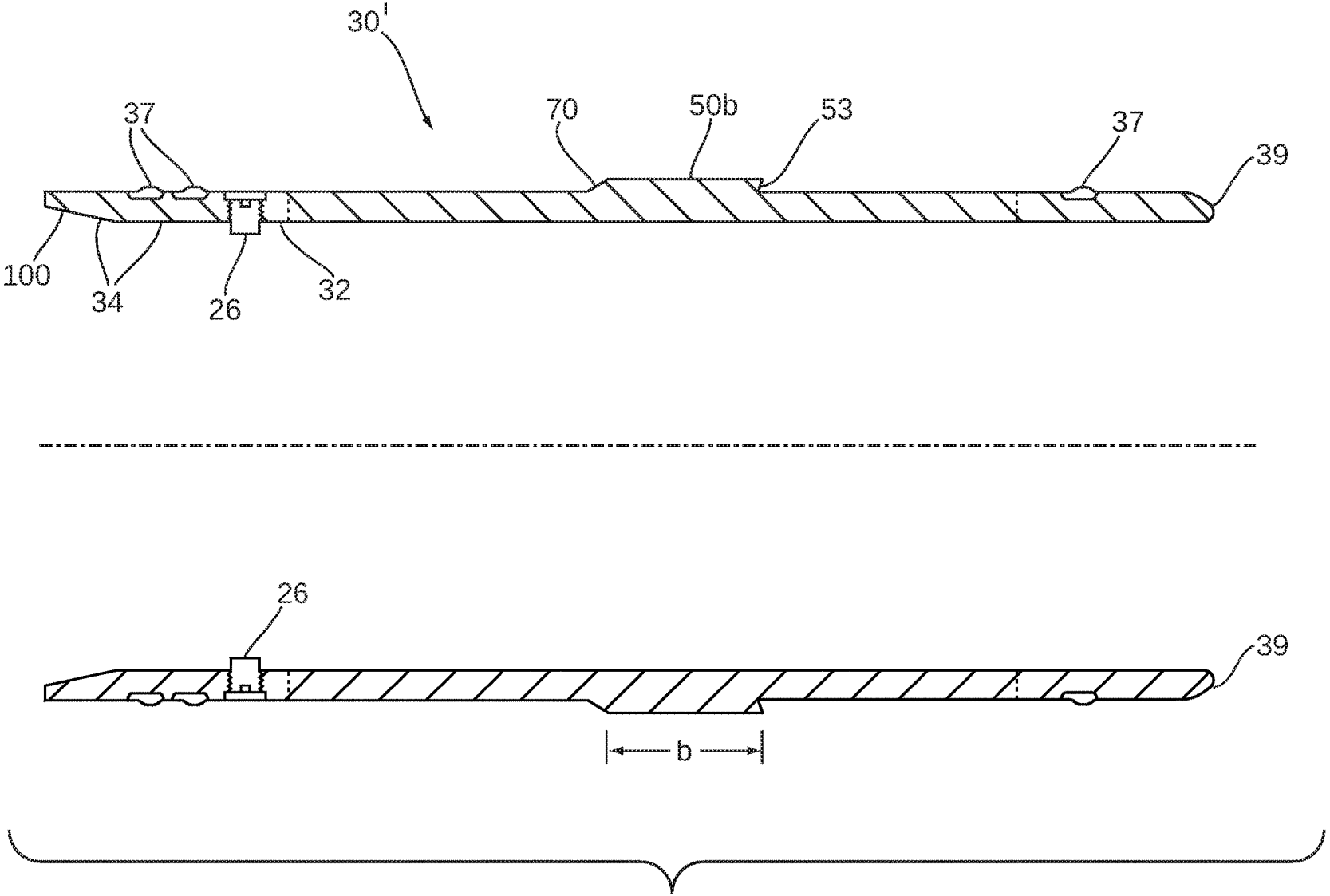
FIG. 4 is a cross-section of the baffle member of FIG. 3.

Baffle member 30' shown in FIGS. 3-4 which is adapted for engagement with an annular recess 16" in a landing sub 14*b* situated in well casing uphole of the landing sub 14*a*, has collet finger protuberances 50*b* of length (width) "b" thereon for matingly engaging annular recess 16" in penultimate landing sub 14*b*, annular recess 16" being of lesser length (width) than annular recess 16' in lowermost landing sub 14*a*, such that first baffle member 30 will only be engaged with lowermost annular recess 16' in lowermost landing sub 14*a*. Successive uphole baffle members 30 conveyed downhole in well casing 12 are similarly provided with protuberances 50 thereon, but each of progressively lesser length (width).

Figure 5:
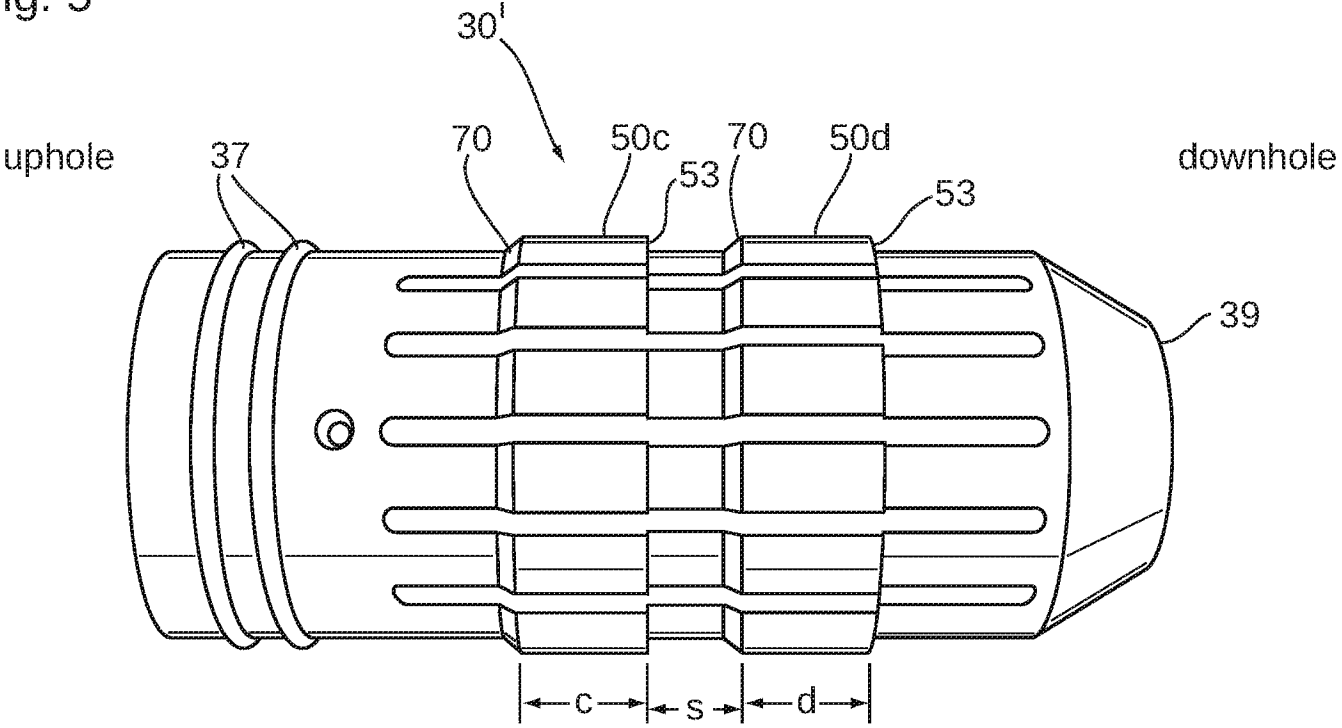
FIG. 5 is a is a side perspective view of another baffle member for use in the system of the present invention.

FIGS. 5-6 show an alternative configuration of a baffle member 30" for use in the present invention. In this instance baffle member 30" is provided with a pair of groups of flexible, radially outwardly-biased collet finger protuberances 50*c*, 50*d* on the periphery thereof, which may be of varied length (width) "c", "d", and/or whose spacing "s" therebetween may vary, depending on the particular landing sub 14 within well casing 12 which is desired to be engaged. Such protuberances 50*c*, 50*d* are adapted to only matingly engage with similarly dimensioned and spaced annular recesses 16' in a lowermost landing sub 14*a*. Additional baffle members 30, having protuberances 50 thereon of different lengths and separation distance "s" therebetween, when dropped in well casing 12 matingly engage similar uniquely dimensioned annular recesses 16" in unique uphole landing subs 14, so that baffle members 30 may progressively be matingly engaged to successive landing subs 14 progressing uphole in well casing 12, with each baffle member 30 providing a seating surface 34 for a plug member 40, to allow fracking of the formation uphole of the plug member 40 to occur.

Each of radially outwardly-biased collet finger protuberances 50, 50*a*, 50*b*, 50*c*, 50*d* on all baffle members 30, 30', 30", and 30'" may possess a chamfer 70 at an uphole side edge thereof. Alternatively, or in addition, each annular recess 16', 16", etc. may likewise possess a similar chamfer 72 at an uphole side edge thereof.

The purpose of chamfers 70 and/or 72 on uphole side edges of protuberances 50, 50*a*, 50*b*, 50*c*, 50*d* and/or annular recesses 16, 16' respectively is so that upon an upward (i.e. uphole) force applied to a lowermost end of a baffle member 30, 30', 30", 30'" (by a retrieval tool 90 has hereinafter described) such will cause the uphole side edge of collet finger protuberances 50, 50*a*, 50*b*, 50*c*, 50*d* thereon to "ride up" on the uphole (chamfered) side edge 72 of the respective annular recess(es) 16, 16', engaged by the respective collet finger protuberance 50, 50*a*, 50*b*, 50*c*, 50*d*, and thereby cause collet finger protuberances 50, 50*a*, 50*b*, 50*c*, 50*d* to be radially inwardly compressed and thus become disengaged from mating engagement with the respective annular recesses 16, 16', and 16", so as to allow a respective baffle member 30, 30', 30", 30'" to be then withdrawn from the respective landing sub 14*a*, 14*b* and further withdrawn from well casing 12.

Each of collet finger protuberances 50, 50*a*, 50*b*, 50*c*, 50*d*, on a downhole side edge thereof preferably possess a shoulder 53 which when said protuberances are matingly engaged with a respective annular recess 16', 16", prevents further downhole movement of baffle member 30 within well casing 12.

Baffle member 30, at an uppermost portion thereof about an interior peripheral mouth 34 thereof has an inward chamfer 100. Inward chamber 100 on baffle member 30 allows radial-outwardly extending dogs 92 on a retrieving tool 90 (see FIGS. 12-14 and as more fully described below) to be radially compressed and thereby allow the retrieving tool 90 to pass through baffle member 30.

Figure 12:
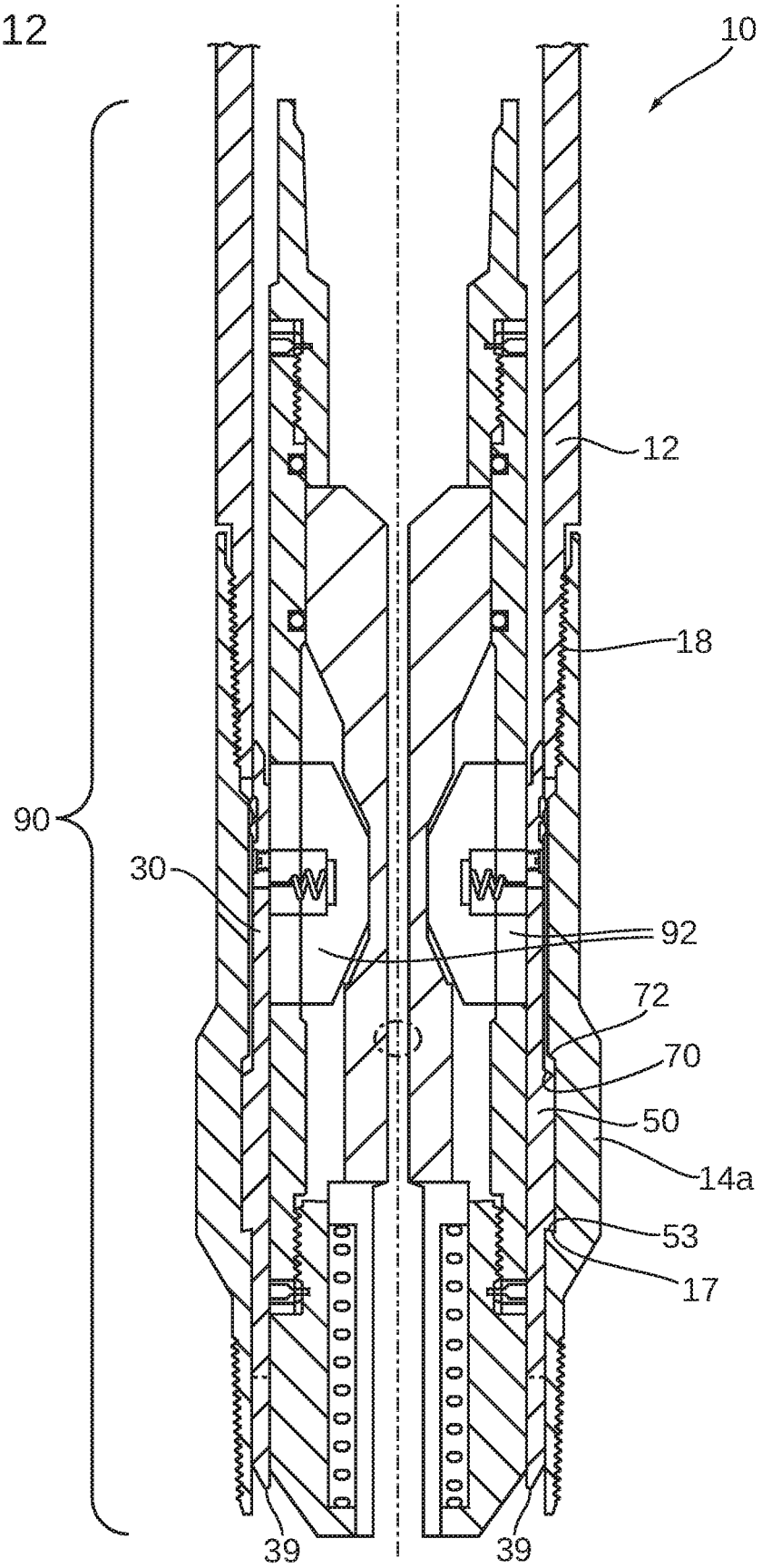
Figure 13:
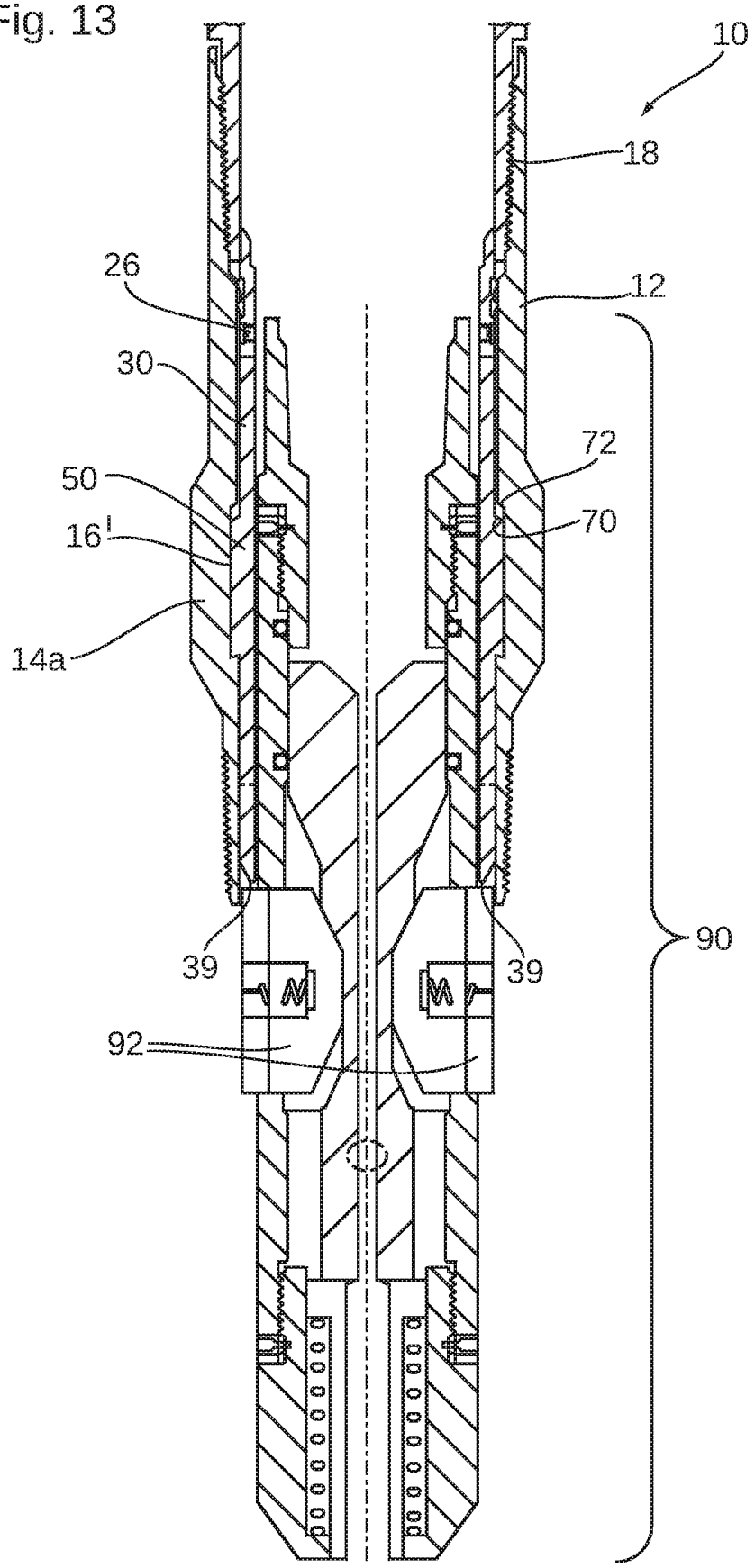
Figure 14:
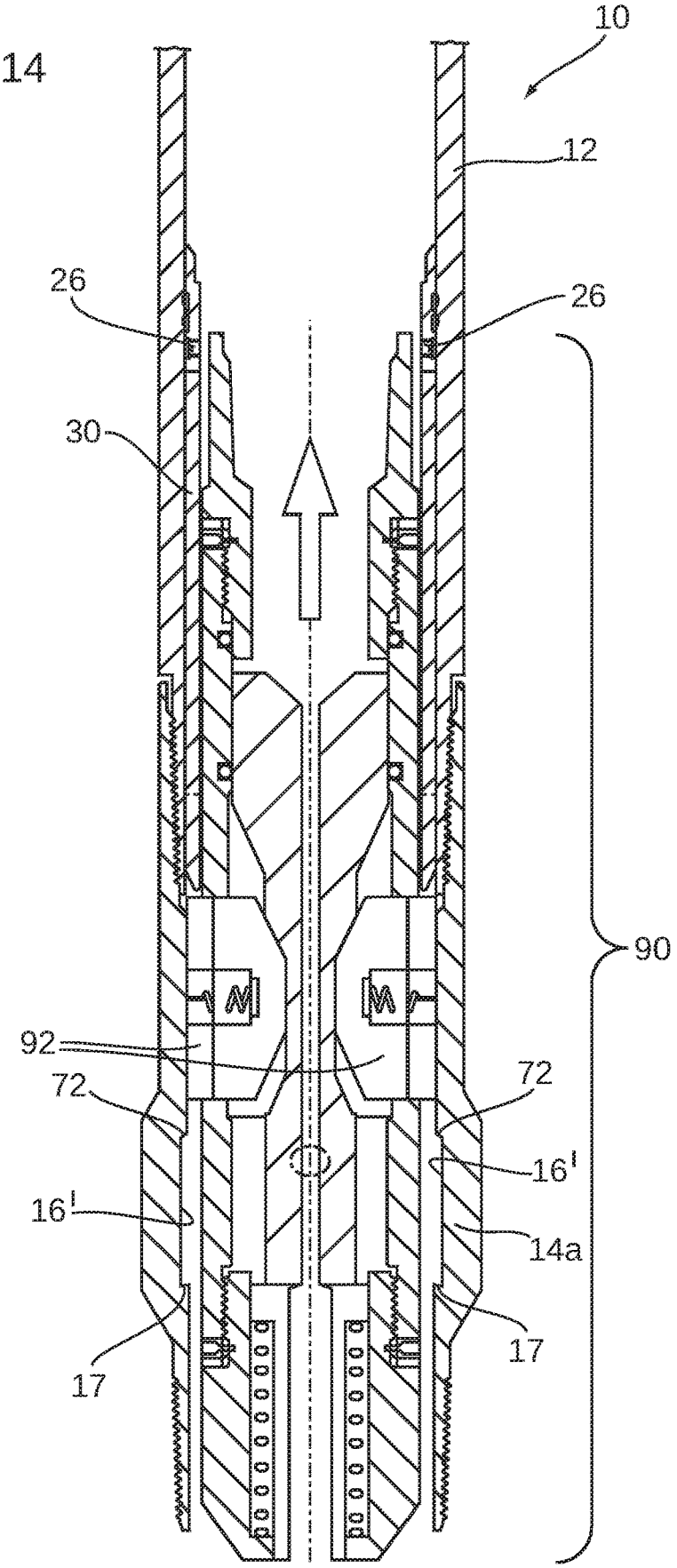

A lowermost portion of baffle member 30 is provided with a shoulder 39 which allows said radially-outwardly extending dogs 92, after having passed downhole through baffle member 30 and when then allowed to be radially outwardly extended, to abut shoulder 39 to allow retrieving tool 90 when pulled uphole to additionally pull baffle member 30 uphole also, as shown sequentially in FIGS. 12-14.

Such shoulder 39 may be bevelled, as shown most clearly for example in FIGS. 2, 4, & 6.

Figure 9:
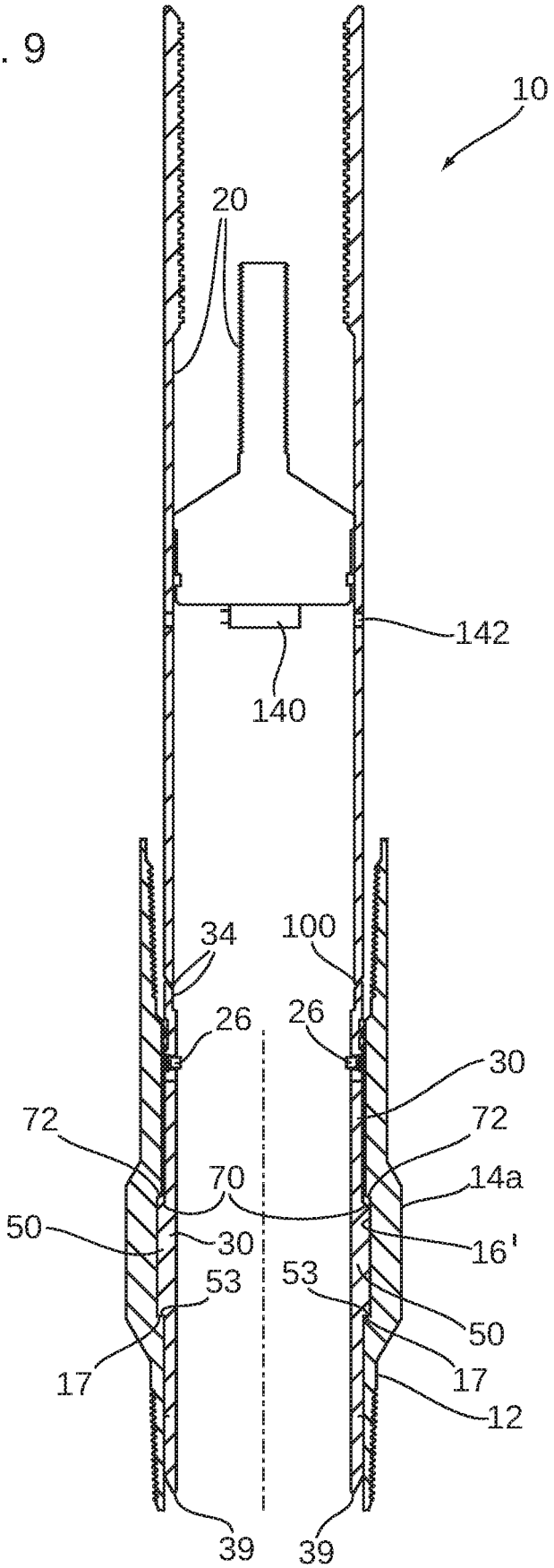
Figure 10:
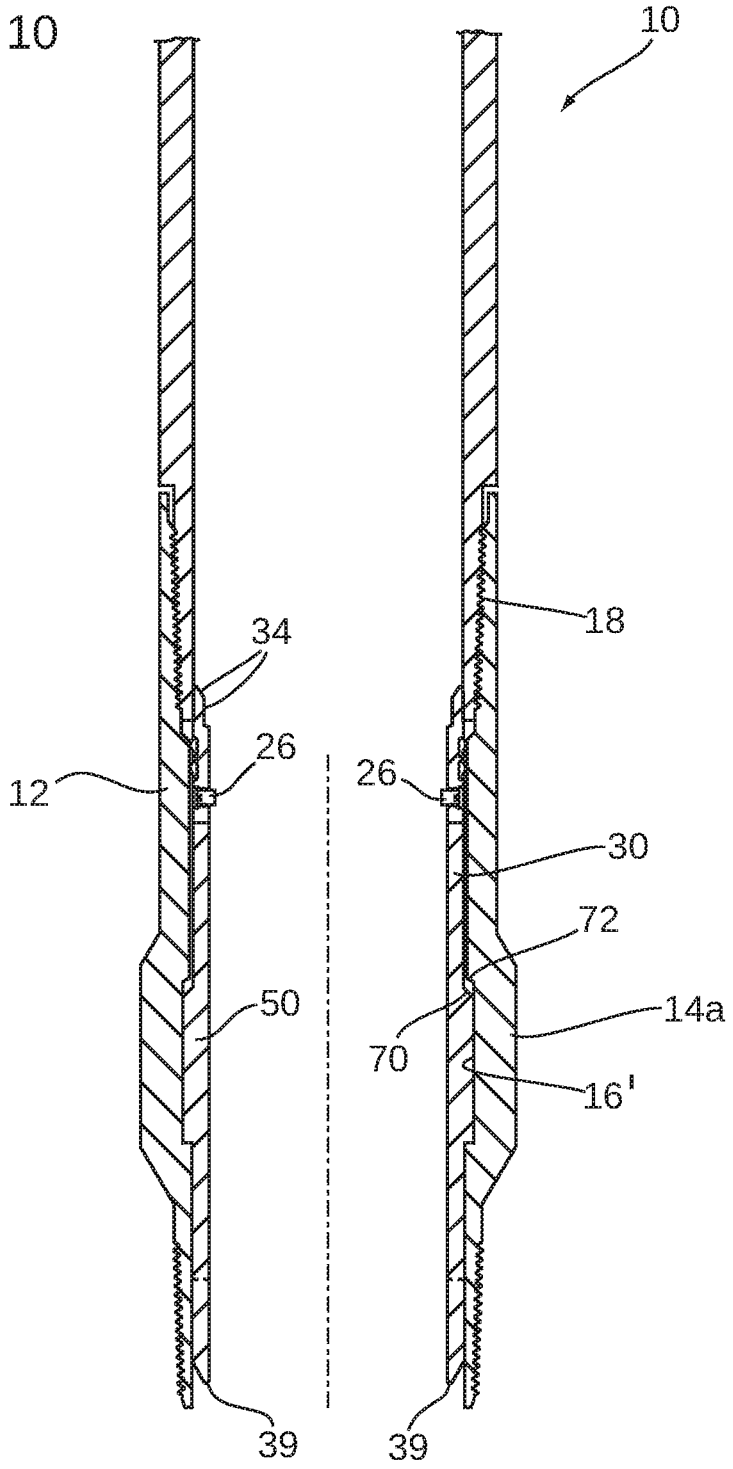

In a preferred embodiment, explosive charge(s) 142 are provided on conveying tool 20, and preferably on a downhole side of conveying head 22 thereof as shown in FIGS. 8, 9. Such explosive charge 142 provides a further advantage of the system/method of the present invention 10 to be realized, namely allowing for the accurate perforation of the well casing 12 in a region and at a depth proximate to and immediately above the matingly engaged baffle member 30, thereby avoiding the need for further or other locator tools to position the explosive charge 140 along the well casing 12, and further avoiding inaccuracy in depth location of the perforating charge 140 along well casing 12.

In such preferred embodiment, after a baffle member 30 has been lowered and respectively become matingly engaged to an annular recess 16 in a particular landing sub 14, an upward force applied to conveying head 22 via the wireline or coil tubing to which conveying head 22 is coupled shears the shear pins 26 and thereby decouples conveying head 22 from baffle member 30. Thereafter coupling head 22 and explosive charge 140 thereon may together be lifted slightly uphole in well casing 12 to a desired distance above baffle member 30 and corresponding landing sub 14, and explosive charge(s) 140 thereon may be detonated to create perforations 142 in well casing 12 at such desired location(s) along well casing 12.

The conveying tool 20 and detonated explosive charges 140 may then be raised from within well casing 12.

A plug member 40 may then be lowered in well casing 12, which plug member 40 (typically a ball member) then rests on sealing surface 34 on baffle member 30 to thereby isolate zones of the well casing 12 below the landed baffle member 30. If desired, a packer member (not shown) may be lowered downhole and actuated a distance uphole from the ball member 40 to isolate the well casing 12 above the packer. Such packer member is not however necessary, as explained below. Pressurized fracking fluid may then inject in the well casing 12 in the region intermediate the packer member (not shown) and the ball member 40 to thereby frac the formation in such desired location.

Figure 15:
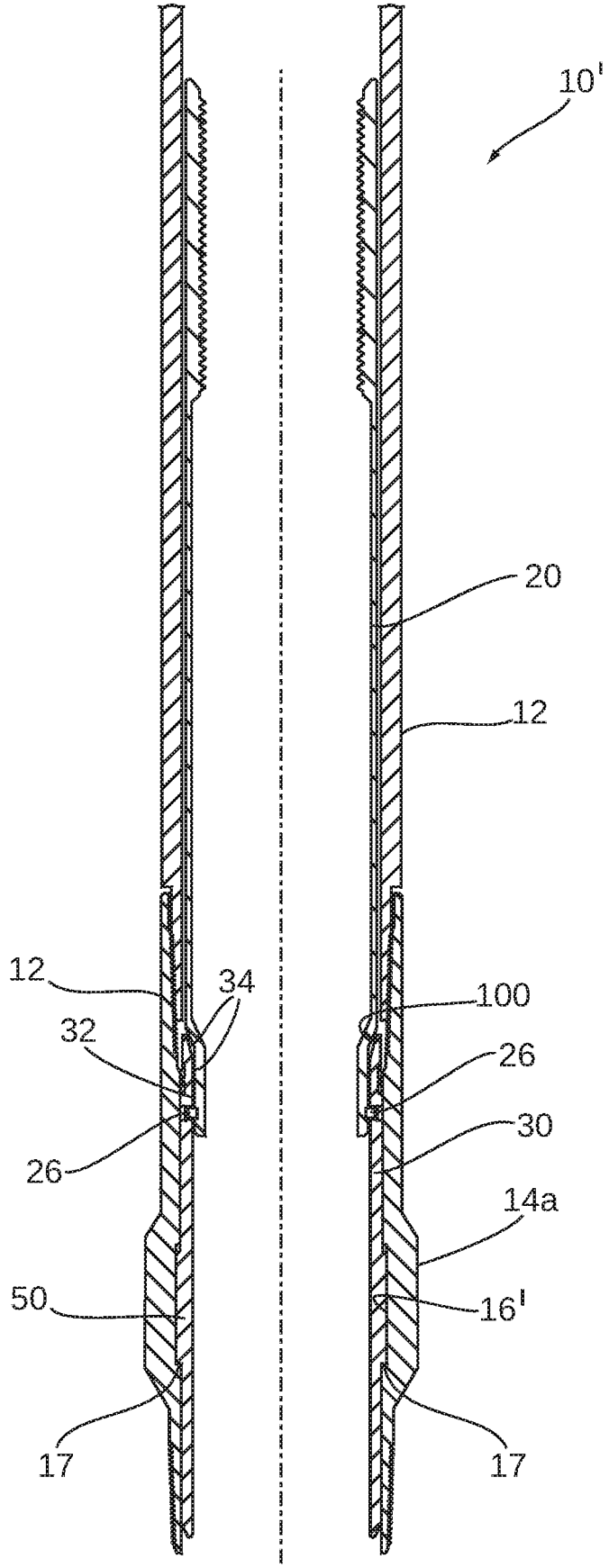
FIG. 15 is an alternative configuration for the conveying tool and the method for directing the conveying tool to the desired landing sub, wherein the conveying tool is attached to threaded pipe (or alternatively coiled tubing)

FIG. 15 of the drawings shows an embodiment 10' of the invention where the baffle member 30 is conveyed downhole to engage a particular landing sub 14 via a conveying tool 20 which comprises a tubing member as shown, such as coil tubing. Embodiment 10' may be employed in deviated well casings, wherein the coil tubing can push the conveying tool 20 and conveying head 22 to the desired region of the well casing 12 and desired landing sub 14.

Figure 16:
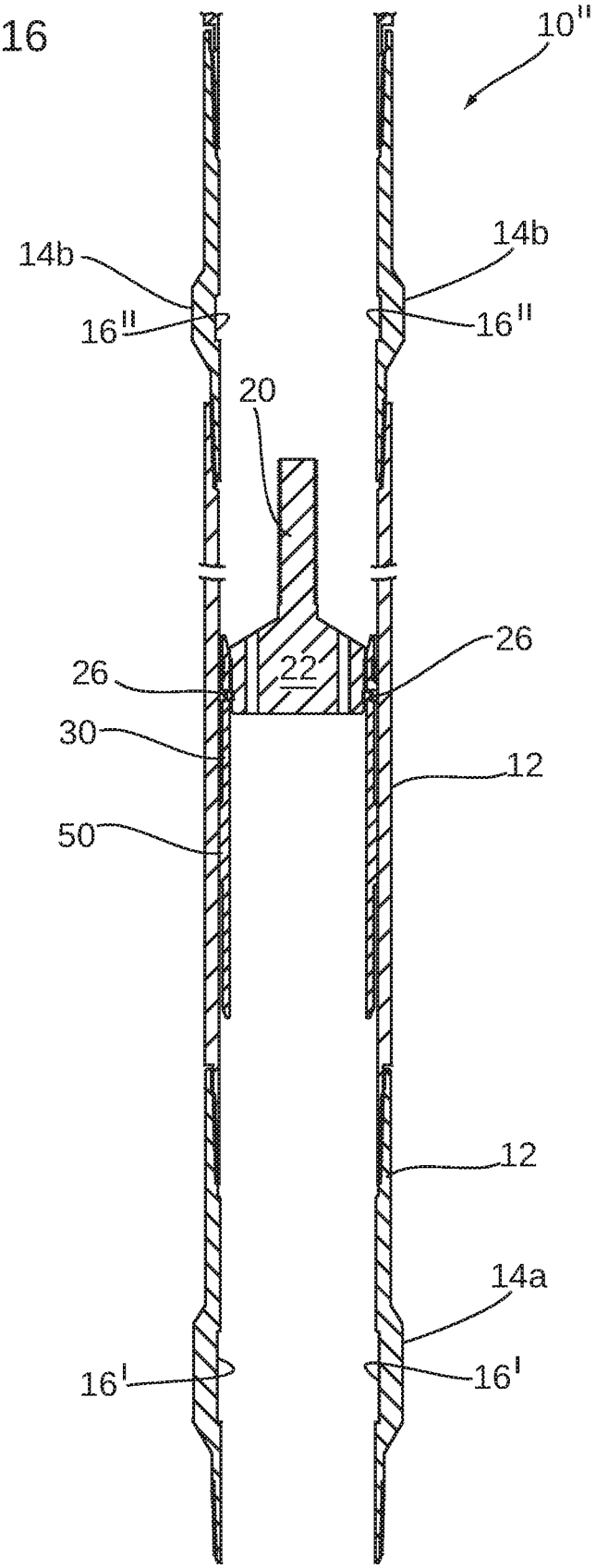
FIG. 16 is an alternative configuration for the conveying tool and method for directing same along the well casing, wherein the conveying tool is attached to and conveyed by a wireline (not shown).

FIG. 16 of the drawings shows an embodiment 10" of the invention where the baffle member 30 is conveyed downhole to engage a particular landing sub 14 via a conveying tool 20 having conveying head 22 thereon, which conveying tool 20 is simply threadably coupled to and suspended from a wireline. Embodiment 10" may be employed in vertical wells, wherein the weight of the conveying head 22 and coupled baffle member 30 allows same to be directly vertically lowered within the well casing 12.

Operation of a Preferred Embodiment of the Invention

In order to achieve certain desired advantages of the invention, the operation of a preferred embodiment and method to selectively and successively perforate and frack a particular zone of a formation, commencing from a most distal end of a well casing 12 in the desired fracking zone, is described below.

Firstly, a plurality of landing subs 14 spaced along a well casing 12 is located in a well drilled within a hydrocarbon formation.

Each of landing subs 14 have one or more annular recesses 16 therein, being of a progressively lesser width progressing uphole from a most distal end of the wellbore, A lowermost landing sub 14 in a zone to be fracked possesses the annular recess 16 of greatest width. Alternatively, each landed sub 14 may possess a plurality of annular recesses 16, of unique but varying widths and/or spacing therebetween, to allow only a single baffle member 30 having similarly-configured collet finger protuberances 50, to uniquely engage same.

A first (initial) baffle member 30 is affixed to a downhole end of conveying tool 20 via frangible means such as shear pins 26. Baffle member 30 has radially-outwardly biased collet finger protuberances 50 thereon, configured to matingly engage only the unique annular recess(es) 16 within a lowermost landing sub 14 of well casing 12 in a zone to be fracked.

Thereafter, the conveying tool 20 and frangibly coupled first baffle member 30 are together lowered downhole in well casing 12 until said collet finger protuberances 50 on baffle member 30 matingly engage annular recess(es) 16 in lowermost landing sub 14*a* in a zone of such well casing to be fracked.

Thereafter, an uphole force is applied to conveying tool 20 via the wireline or coiled tubing to which conveying tool 20 is coupled, thereby shearing shear pins 26 and de-coupling baffle member 30 from conveying tool 20.

Conveying tool is then raised slightly within well casing 20 to a position immediately above baffle member 30, and an explosive charge 140 on the lowermost portion of coupling head 22 is detonated, thereby creating perforations 142 in well casing 12 immediately above the lowermost landing sub 14.

The conveying tool is then withdrawn from the well casing 12, and a plug member 40 is flowed down well casing 12. Plug member 40 will then be caused to sit in sealing surface 34 on baffle member 30, thereby isolating further downhole portions of the wellbore and causing said plug member 40 to abut an uppermost portion of said baffle member 30 so as to prevent passage of pressurized fluid downhole of baffle member 30.

A packer member on coil tubing may then be inserted downhole, and actuated above perforations 142 to thereby isolate regions of the well casing 12 above the packer, and a pressurized fluid injected in the coil tubing to frac the well casing 12 in the region intermediate the packer and the plug member 40. It is not necessary, however, to utilize a packer member (not shown) to isolate sections of the well casing 12 above baffle member 30, since well casing 12 is not otherwise perforated above created perforations 142 therein and loss of pressurized fluid into other uphole regions of the well casing 12 will not thus occur.

The plug member 40 is then caused to be removed from well casing 12. This is done by plug member 40 preferentially being a dissolvable ball, which then dissolves after being in contact with such pressurized fluid, which fluid is typically acidic or acidic fluid may then be injected downhole to dissolve plug member 40. Alternatively, plug member 40 may merely have been lowered on a wireline, and after completion of the fracking operation may then be pulled to surface.

The aforesaid steps are repeated, in each instance with second and additional baffle members 30. In each iteration, the baffle member 30 has collet finger protuberances 50 thereon of a lesser width, or of a different spacing, which allow respective engagement of progressively more uphole annular recesses 16 in each of the plurality of landing subs 14, until said hydrocarbon formation has been completely fracked or treated.

At the culmination of the fracking operation, a retrieving tool 90 having pressure actuated radially-extending dogs 92 thereon, is lowered downhole below the lowermost of the baffle members 30 matingly engaged within well casing 12 to respective landing subs 14, as shown sequentially in FIGS. 12 & 13.

Retrieving tools 90 having pressure actuated radially-outwardly extending dogs 92 are well known to persons of skill in the art and are readily commercially available. Accordingly, retrieving tool 90, a particularly suitable version for these purposes being shown in FIGS. 12-14, is not further described herein.

Upon actuation of radially outwardly extending dogs 92 on retrieving tool 90, such dogs 92 engage shoulder 39 on lowermost portion of the lowermost baffle member 30, as shown in FIG. 14. Upward force exerted on retrieving tool 90 and by extension lowermost baffle member 30 causes "riding up" of chamfered uphole edge 70 of protuberances 50 on chamfered uphole edge 72 of annular recess 16', thereby causing disengagement of protuberances 50 with annular recess 16' and allowing retrieving tool 90 and lowermost baffle member 30 to be withdrawn uphole, as shown in FIG. 14.

Additional upward force applied to retrieving tool 90 causes similar disengagement of successive uphole baffle members 30 with respective landing subs 14, thereby additionally and advantageously allowing such additional uphole baffle member 30 to be withdrawn from well casing 12 at the same time, and via only a single retrieving tool 90.

Advantageously, well casing 12 has thus had removed therefrom all actuating and isolating tools, thereby retaining its maximum diameter and reducing to the greatest extent possible any flow restrictions in well casing 12. Such elimination of flow restrictions thereby reduces any pressure drops along such well casing 12 and thereby, for a given pumping horsepower, maximizes the amount of hydrocarbons which may then be pumped to surface.

In such manner hydrocarbons entering the created perforations 142 in the well casing 12 are then able to flow in a well casing 12 of maximum diameter, thereby maximizing to the greatest extent the flow of hydrocarbons through the well casing 12 when producing such hydrocarbons to surface.

The above description of some embodiments of the present invention is provided to enable any person skilled in the art to make or use the present invention.

For a complete definition of the invention and its intended scope, reference is to be made to the summary of the invention and the appended claims read together with and considered with the detailed description and drawings herein on a purposive interpretation thereof.

We claim:

1. A retrieving tool for retrieving an annular hollow baffle member in a wellbore, the annular hollow baffle member comprising an interior bore and radially outwardly-biased collet finger protuberances on an exterior thereof matingly engaging a correspondingly-dimensioned annular recess within a landing sub of a well casing of the wellbore, the retrieving tool comprising:

a tubular body; and a plurality of radially-outwardly-extendable dogs on the tubular body;

wherein the tubular body and plurality of radially-outwardly-extendable dogs are sized that, when the plurality of radially-outwardly-extendable dogs are retracted, the retrieving tool is movable through the interior bore of the annular hollow baffle member to a position below a lowermost thereof, and when the plurality of radially-outwardly-extendable dogs are extended after the retrieving tool moves to the position below the lowermost of the annular hollow baffle member, the plurality of radially-outwardly-extendable dogs radially engageable with the landing sub and axially engageable with the lowermost of the annular hollow baffle member for pulling the annular hollow baffle member uphole and disengaging the annular hollow baffle member and the landing sub for retrieving the entirety of the annular hollow baffle member.

2. A method for retrieving one or more tubular baffle members in a wellbore, each of the one or more tubular baffle members comprising an interior bore and radially outwardly-biased collet finger protuberances on an exterior thereof matingly engaging a correspondingly-dimensioned annular recess within a respective one of a plurality of landing subs of a well casing of the wellbore, the method comprising:

lowering in said well casing a retrieving tool having radially-outwardly-extendable dogs thereon downhole and passing said retrieving tool consecutively through the interior bore of each of the one or more tubular baffle members until reaching a most-downhole one of the one or more tubular baffle members to a position below a lowermost of said most-downhole tubular baffle member;

actuating said radially-outwardly-extendable dogs on said retrieving tool and extending same radially outwardly so as to engage one of said plurality of landing subs that said most-downhole tubular baffle member is engaged therewith; and pulling upwardly on said retrieving tool to cause said radially-outwardly-extendable dogs to contact an abutting portion on said most-downhole tubular baffle member thereby causing said collet finger protuberances to be radially inwardly depressed so as allow pulling an entirety of said most-downhole tubular member and entireties of all remaining uphole tubular baffle members from engagement with respective of said plurality of landing subs and cause all of said tubular baffle members in their entireties to be pulled uphole and withdrawn from said wellbore, for preventing said most-downhole tubular baffle member and entireties of all remaining uphole tubular baffle members from remaining downhole and restricting flow in the well casing.

3. A baffle system for use in a well casing having a plurality of landing subs longitudinally spaced therealong, for fracking or injection of treating fluid into a hydrocarbon formation via existing or created perforations in said well casing, said system comprising:

an annular hollow baffle member, insertable downhole within said well casing, having (i) a seating surface configured to allow a plug member, when dropped downhole in said well casing, to abut thereagainst and thereby prevent pressurized fluid injected downhole in said well casing from travelling past said plug member and through said annular hollow baffle member and thus downhole;

(ii) radially outwardly-biased collet finger protuberances on an exterior of said annular hollow baffle member configured to matingly engage a correspondingly-dimensioned annular recess within a particular one of said plurality of landing subs within said well casing; and (iii) an interior bore, dimensioned so as to allow a retrieving tool having radially-outwardly-extendable dogs thereon, when said radially-outwardly-extendable dogs thereon are retracted, to pass therethrough;

said correspondingly-dimensioned annular recess within each of said plurality of landing subs, on a downhole side edge thereof, possessing a shoulder portion which prevents further downhole movement of said annular hollow baffle member within said landing sub upon said collet finger protuberances on said annular hollow baffle member engaging said correspondingly-dimensioned annular recess on said landing sub; and said correspondingly-dimensioned annular recess and/or said collet finger protuberances at an uphole side edge thereof possessing a first chamfer configured so that upward force applied to said annular hollow baffle member causes radial compression of said collet finger protuberances and disengagement of said collet finger protuberances with said correspondingly-dimensioned annular recess and thus release of said annular hollow baffle member from mating engagement with said correspondingly-dimensioned annular recess to allow an entirety of said annular hollow baffle member to be withdrawn uphole in said well casing via said retrieving tool when said radially-outwardly-extendable dogs of said retrieving tool pass through the interior bore of said annular hollow baffle member;

wherein when said radially-outwardly-extendable dogs of said retrieving tool after having passed through said interior bore are thereafter radially outwardly extended, said radially-outwardly-extendable dogs of said retrieving tool are configured so as when pulled uphole then abut a lowermost portion of said annular hollow baffle member and so that said retrieving tool and said hollow baffle member in its entirety are together pulled uphole, for preventing said annular hollow baffle member or portions thereof remaining downhole and thereby restricting flow of fluids within the well casing.

4. The baffle system as claimed in claim 3, wherein said annular hollow baffle member comprises a second chamfer situated at an uppermost portion thereof about an interior peripheral mouth thereof for radially compressing said radially-outwardly-extendable dogs on said retrieving tool, when inserted in said interior peripheral mouth of said annular hollow baffle member, thereby allowing said retrieving tool to pass into and through said annular hollow baffle member; and wherein said annular hollow baffle member has an abutting portion to allow said radially-outwardly-extendable dogs, after having passed into or through said annular hollow baffle member and subsequently radially-outwardly extended, to then abut said abutting portion and allow said retrieving tool, when pulled uphole, to thus pull said annular hollow baffle member uphole.

5. The baffle system as claimed in claim 3, further comprising a plurality of annular recesses respectively situated within a corresponding plurality of said landing subs spaced apart from each other along said well casing, a most downhole of said landing subs and said annular recess therein having the greatest annular width of said plurality of annular recesses, with remaining uphole of said plurality of annular recesses having, when progressing uphole along said well casing, progressively narrower widths.

6. The baffle system as claimed in claim 3, further comprising a plurality of annular recesses respectively situated within each of said plurality of said landing subs, said annular recesses spaced a unique distance apart from each other in each of said landing subs, and configured to be engaged by said annular hollow baffle member having a correspondingly-spaced plurality of collet finger protuberances thereon.

7. The baffle system as claimed in claim 3, wherein said conveying tool possesses an electrically-actuated explosive charge for perforating said well casing at a specific desired location.

8. The baffle system as claimed in claim 7, each landing sub having therein a respective one of said plurality of annular recesses, wherein said annular hollow baffle member, when matingly engaged within a respective one of said landing subs, thereby positions said explosive charge immediately above said respective of said plurality of landing subs, so that said explosive charge, when detonated, perforates the well casing immediately above said respective one of said plurality of landing subs.

9. The baffle system as claimed in claim 3, further comprising a conveying tool for initially positioning said baffle member in the wellbore; wherein a lowermost end of said conveying tool is affixed, coupled, or engaged to the annular hollow baffle member.

10. The baffle system as claimed in claim 9 wherein said conveying tool is frangibly affixed to said annular hollow baffle member uphole of said radially outwardly-biased collet finger protuberances on said annular hollow baffle member.

11. The baffle system as claimed in claim 9, wherein said conveying tool has a bypass port therein to allow fluid to flow therethrough when lowering said conveying tool and annular hollow baffle member in said well casing.

12. The baffle system as claimed in claim 3, wherein said radially outwardly-biased collet finger protuberances are situated approximately midpoint on said annular hollow baffle member intermediate annular seals situated on an outer periphery of said annular hollow baffle member at mutually opposite ends thereof.

* * * * *